United States Patent [19]

Seymour

[11] Patent Number: 4,735,684

[45] Date of Patent: Apr. 5, 1988

[54] MULTISTAGE PULP BLEACHING CONTROL PROCESS

[76] Inventor: George W. Seymour, 2841 Parkwood Dr., Brunswick, Ga. 31520

[21] Appl. No.: 933,848

[22] Filed: Nov. 24, 1986

[51] Int. Cl.[4] ..... D21C 9/00; D21C 9/06; D21C 9/10

[52] U.S. Cl. ..... 162/49; 162/60; 162/62

[58] Field of Search ..... 162/60, 238, 49, DIG. 10, 162/258, 252, 61, 62, 263, 52, 246; 8/156

[56] References Cited

U.S. PATENT DOCUMENTS 4,096,028 6/1978 Rosenberger ..... 162/49
4,207,141 6/1980 Seymour ..... 162/263

FOREIGN PATENT DOCUMENTS 464681 8/1973 U.S.S.R. ..... 162/238

OTHER PUBLICATIONS

Seymour, "Oxidation Potential Control of Pulp Chlorination", Tappi, vol. 40, No. 6, Jun. 1957.

Burnett, *Pulp and Paper Magazine of Canada,* vol. 71, No. 14, Jul. 17, 1970, p. 57.

*Primary Examiner*—Steve Alvo

[57] ABSTRACT

Control of pulp and water flow rates out of a bleaching tower in a multistage pulp bleaching process wherein each stage comprises a bleaching tower and a washing drum, comprises the steps of (a) measuring total weight of pulp composition per square meter on at least one washing drum and from such measurement and the speed of rotation and area of the washing drum surface and the consistency of pulp composition, determining the total weight per unit time of pulp and of water coming out of the bleaching tower previous to said washing drum, and (b) controlling the rate of pulp and water flow out of said previous tower based on the determination of the total weight per unit time of pulp and of water as determined in step (a), and (c) controlling the amount of bleaching chemical flow to the pulp going to any following stage to match the pulp flow rate as determined from the measurement of step (a) and the percentage of bleaching chemicals to be applied. Step (a) is readily carried out utilizing a backscatter nuclear radiation gauge or capacitance measuring instrument or a microwave cavity perturbation apparatus. The result is a more uniform rate through the process and improved control over bleaching chemicals addition.

6 Claims, 3 Drawing Sheets

MULTISTAGE PULP BLEACHING CONTROL PROCESS

BACKGROUND OF THE INVENTION

1. Field of the Invention

The present invention relates to a method of controlling the rate of pulp and water flow in a multistage pulp bleaching system wherein each stage comprises a bleaching tower followed by a drum type washer and particularly to a method of controlling the rate of pulp and water flow out of a bleaching tower and over the following drum type washer in a bleaching stage and into any following bleaching stage such that the rate of pulp flow is known with accuracy and is more uniform than with conventional control methods.

2. Description of Prior Art

In a conventional system, control of the pulp entering the bleaching system is carried out utilizing a flow meter and a consistency controller at the entrance of the first stage. The pulp flow rate from each successive stage is then controlled by adjusting an outlet valve from each bleaching tower responsive to a level control instrument which measures the pressure in the tower as an indication of the level of contents in the tower. There are times, however, when it is advantageous to shut down one part of the plant for a short time and continue to operate the remaining stages by drawing down the level in the stage following the one that is temporarily shut down. Moreover, if there is a temporary upset in one of the latter stages then the previous stages can be operated for a short while by building level in the previous towers. The conventional control system is unsatisfactory for these cases where only part of the system is operative.

The washer following the first stage bleaching tower thickens the pulp composition to what is referred to as medium consistency, i.e., a consistency of about 10 to 16 percent pulp in water. The first stage is usually an upflow type of tower whereby the overflow is at the same rate as the input flow rate of the pulp and water mixture. The remaining two to five stages are usually run at the consistency coming off the previous washer drum except for the small volume of liquid from added chemicals and steam. The effluent from the first through the penultimate stages usually has a consistency of about 10 to 16 percent pulp in water and is run into a downflow type tower in a succeeding stage. The effluent from the last stage usually has a consistency of about 10 to 16 percent pulp in water. In some cases the pulp and water mixture is run through a smaller upflow tower before entering a larger downflow tower. In both these cases, however, the pulp and water mixture is held in the larger downflow tower for one to five hours by virtue of the tower size and rate of flow of the pulp and water mixture which is continuously introduced at the top and continuously removed at the bottom of such tower.

In most cases the pulp composition in the bottom portion of a downflow tower is diluted to about three percent pulp in water to facilitate pumping out of the tower and into the following washer and preferably is diluted further to one or one and a half percent pulp in water after leaving the tower and prior to entry to the washer to improve the pulp mat formation on the pulp washer and to give a better wash.

Some downflow towers are now equipped with medium consistency pumps for removal of the pulp composition from the bottom of the tower at the 10 to 16 percent consistency. This removal at medium consistency eliminates some of the problems experienced with introducing dilution water to a tower but creates a problem of instrument sensitivity since the pulp composition leaving the tower is then at the 10 to 16 percent consistency. A twelve percent consistency coming out of a tower instead of three percent increases the amount of pulp per foot of level measured by a factor of four and thus increases the flow rate errors caused by the larger amount of pulp represented by 0.5 percent instrument sensitivity in the level measuring device.

The system in most general use to inject water into the lower section of a downflow bleaching tower comprises nozzles located in a lower zone some two to three meters above the bottom of tne tower and spaced evenly around the tower. Agitation of the pulp composition is carried out in this lower zone with mechanical mixers to provide uniformity of consistency of the pulp composition in the lower zone. In essence then the 10 to 16 percent consistency pulp composition is floating above the three percent pulp composition in the tower bottom. This is possible since entrained air in the higher consistency pulp composition generally makes it have a lower specific gravity than the lower consistency pulp composition in said lower zone. The diluted pulp composition in the bottom section of the tower is pumped out as previously described and then additionally diluted to slightly over one percent pulp in water just before it enters the washer.

The flow rates of dilution water are not altered frequently in normal running and are not used for minute to minute tower level control purposes. In the normal control cycle when a downflow tower outlet valve is opened wider to lower the level in the tower, the flow rate of dilution water is not changed. The pulp and water in the agitated dilution zone in the bottom of the tower is then being pumped out faster with the same amount of dilution water being introduced. This increases the consistency of the pulp composition in the lower zone of the tower and additionally increases the rate of pulp flow out of the tower. This has a larger effect on uniformity than generally realized since at normal rates the contents in the bottom zone of a downflow tower is completely changed in less than five minutes.

The chemical additions to each stage are normally based upon a given percentage of the weight of pulp. For example, the third stage of bleaching is frequently a chlorine dioxide stage with a chemical application of about one percent chlorine dioxide based on the weight of the pulp which amounts to ten kilograms of chlorine dioxide per metric ton of pulp. Running at a rate of 750 metric tons of pulp per day (0.521 metric tons per minute), it is necessary to apply 5.21 kilograms of chlorine dioxide per minute to the pulp leaving the previous washer. The required percentage of chemical applied to the pulp is continually changing as is the pulp rate of production due to factors outside the bleaching operation. These chemical demand changes are known from other sensors within each stage and from data taken from other stages. When, however, the rate of pulp flow out of the towers varies due to the control function then the amount of chemicals applied is in error by a direct percentage of the tonnage rate error. In addition to these errors, the calculated chemical demand from other sensors and stages is also affected by erroneous tonnage values within the other stages. This leads to serious inefficiencies in the bleaching operation.

SUMMARY OF THE INVENTION

This invention overcomes the problems of the prior art by providing a measure of the total weight per unit time of pulp composition comprising pulp and water, that is leaving a washer drum to provide a direct control over the rate of pulp flow from the previous tower and provides a measured and controlled weight of pulp composition comprising pulp and water introduced into the following stage that can be directly related to pulp alone by means of a consistency estimation.

The total weight per square meter of pulp composition comprising pulp and water on washer wire surface is measured with a nuclear radiation backscatter gauge at a point on the washer drum after the vacuum break and before the take off point. Alternatively, but less preferably, a measure of the weight of said pulp composition per square meter of washer wire surface is obtained by utilizing a capacitance measuring instrument or microwave instrument to measure the weight of water per square meter of wire surface at the same point (i.e. at a point on the washer drum after the vacuum break and before the take off point) and converting the measured weight of water to a measure of weight of pulp composition per square meter of wire surface utilizing estimated or measured consistencies at the outlet of the previous tower. Any one of these values or any combination of these measurements can be used to calculate a very accurately repeatable tonnage of pulp going over the washer. By multiplying this measured value of kilograms per square meter of washer wire surface by the speed of rotation of the washer drum in revolutions per minute and the area of the drum surface (calculated by multiplying the width of the drum by pi and the drum diameter), the kilograms per minute of the measured material can be determined. This value is the total weight of pulp composition per minute but can easily be converted into pulp alone and/or water alone by a consistency estimation. This value is readily used as a basis for increasing or decreasing the flow of pulp and water from the bleaching tower to obtain or maintain the desired rate. This control of flow rate from the previous bleaching tower can be carried out manually by adjusting a valve in the outlet line from the tower or automatically in response to determination of total weight per unit time of pulp and of water leaving the tower, e.g. by utilizing a valve at the outlet of the tower automatically controlled in response to measurements by the nuclear radiation backscatter gauge or capacitance measuring instrument or microwave instrument. The calculated rate of production (based on measurement of total mass of pulp composition per square meter of washer wire surface) can be used as a basis for application of the correct amount of bleaching and other chemicals to the following stage. This amount is calculated based on the percentage of chemicals to be applied as conventionally determined by other parameters in the process.

As the flow rate of pulp in and out of the towers is made more uniform by this process, scrubber vents on the towers have much lower volumes of gas to handle and therefore operate more efficiently.

This is a significant improvement over conventional tower level control methods and conventional chemical feed rates to the pulp. The instrument sensitivity to changes in pulp rate of flow to and over the washer is more than thirty times as sensitive as the measurement of level in the tower alone that was previously used for this function.

Any control system response is in direct proportion to the sensitivity of the measuring device. The relative response of any two control systems is proportional to the ratio of the sensitivities of the two measurement signals used. While instrument measurements can be enhanced by statistical means with many readings over a time period, the time required for many readings can be equally effective in statistical enhancement of either of two comparable systems. The method herein does not depend upon any such enhancement for increased sensitivity of more than thirty times that of conventional methods.

As used herein, the term "pulp composition" means a composition comprising pulp and water and any bleaching or other agents that are present. Since the percentages of bleaching and orher agents are small in comparison to the percentages of water and pulp in the composition, the percentages of bleaching and other agents can be ignored in calculating pulp and water based on consistencies.

BRIEF DESCRIPTION OF THE DRAWINGS

The foregoing objects, features, and advantages of the invention will be more fully understood upon a consideration of the following detailed description of preferred forms of the invention, together with the accompanying drawings, in which.

DESCRIPTION OF THE PREFERRED EMBODIMENTS

Figure 1:
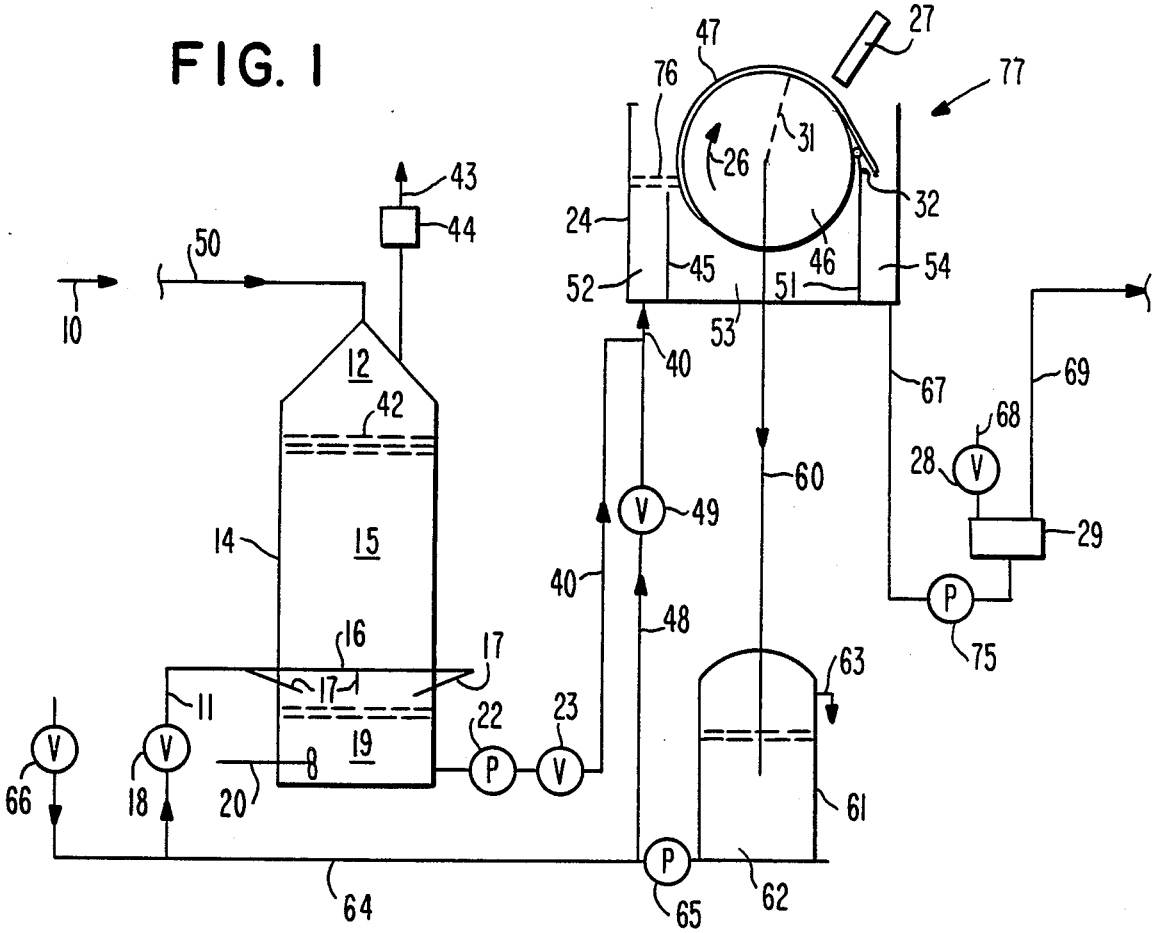
FIG. 1 is a schematic flow diagram of one downflow bleaching tower and washer with associated major equipment.

Referring to FIG. 1, a pulp composition 10 of medium consistency. comprising between 10 and 16 percent pulp in water admixed with bleach composition,enters a downflow bleaching tower 14 via pipe 50 after treatment in a previous stage and admixture of bleach and drops through a air space 12 and onto the surface 42 of pulp composition 15 in the tower 14. The pulp composition 15 continues downward in continuous flow until it reaches a lower zone 19 in tower 14 where it is diluted to about 3 percent pulp in water by recycled water entering through a pipe 11 equipped with a control valve 18 to a circular header 16 and injected into the pulp composition in the tower via nozzles 17 which communicate with header 16. The pulp composition in the lower zone 19 of tower 14 is agitated to provide a uniform composition with an agitator 20. The lower consistency pulp composition formed in lower zone 19 is continuously pumped out of tower 14 with via pipe 40 equipped with valve 23 and pump 22. A flow balance provides equality between the pulp composition input 10 plus the dilution water input via nozzles 17 and the pulp composition flow leaving the tower via pipe 40. If these two are not equal then any excess inputs over the outputs will cause the level of pulp composition in tower 14 to rise, i.e. cause the surface 42 of the pulp composition body in tower 14 to rise, and air will be displaced from the tower through a vent line 43 equipped with a scrubber 44. This air in the tower 14 also contains noxious gases from the bleaching chemicals, and excessive swings in the surface 42 will overload the scrubber 44 causing noxious gases to escape into the atmosphere causing serious polution problems.

Figure 2:
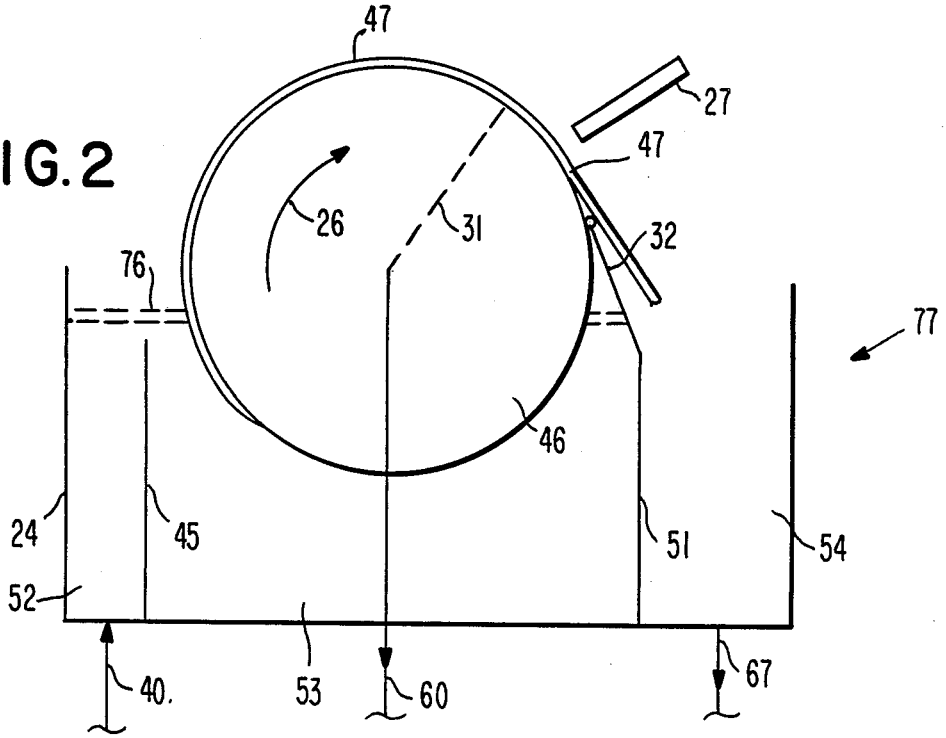
FIG. 2 is a schematic diagram of the washer drum of FIG. 1.

The pulp composition flows via pipe 40 into a drum type washer means 77 as particularly depicted in FIG. 2 comprising a tank 24 equipped with baffle means 45 and dam means 51 and vacuum filter drum 46 (having a wire surface with interstices therein through which vacuum is applied) which rotates as shown by arrow 26. The pulp composition is introduced into a head box 52 of the tank 24 via pipe 40 and overflows baffle 45 into washer vat 53 forming a body 76 of said pulp composition. Pulp from the body 76 is drawn against drum 46 and forms a pulp mat 47 thereon which rotates with the drum and passes a vacuum break 31 on the drum 46 and then is removed from drum 46 at a take off point by doctor means 32. As depicted in FIG. 1, recycle water for washing in said washer means is supplied into pipe 40 via pipe 48 equipped with a valve 49. Filtrate removed from the pulp mat by filter drum 46 is siphoned via pipe 60 to filtrate tank 61 and a body of filtrate is depicted therein (FIG. 1) as 62. The siphoning of liquid in pipe 60 provides the vacuum source for drum 46. The tank 61 is equipped with a vent 63 and a filtrate outlet pipe 64 equipped with a pump 65. The pipe 64 communicates with pipes 11 and 48 and contains a valve 66 which is opened to introduce fresh water into the system or to drain the system.

The pulp mat 47 on being doctored from drum 46 passes over dam 51 into outlet section 54 of tank 24 and passes into a screw conveyor (not shown) in the bottom of section 54 which conveys pulp composition formed from pulp mat 47 to the outlet end of section 54 where the pulp composition leaves washer 77 through an open hole into a pipe 67. The pulp composition falls through pipe 67 and enters a screw type feeder (not depicted) which feeds the pulp composition to a thick stock pump 75 (e.g. a positive displacement pump of the gear type or in some cases a high shear centrifugal pump). The pump 75 pumps the pulp composition into mixer 29 where it is admixed with bleaching chemicals entering the system through pipe 68 equipped with valve 28. Effluent from mixer 29 is routed via pipe 69 to the following stage.

Control of this system with the present invention involves measuring the total weight per square meter of pulp composition (pulp plus liquid) going over the washer drum with a backscatter nuclear radiation gauge 27 located a few inches above the washer drum between the vacuum break 31 as shown in FIG. 2 and the take off doctor 32 as depicted in FIG. 2. The nuclear backscatter radiation gauge 27 comprises a radiation source which transmits radiation which passes through pulp mat 47 whereby backscattered radiation is detected by a radiation detector. The detected radiation is correlated with total mass per square meter of pulp composition an increased total mass in pulp mat 47 increases the amount of backscattered radiation and the radiation source is at a fixed position to all other mass before it. Such a device is described in applicant's U.S. Pat. No. 4,207,141. A very suitable backscatter nuclear radiation gauge is sold by NDC Systems of Monrovia, California.

The total weight in kilograms per square meter (as measured by the backscatter nuclear radiation gauge 27) when multiplied by the drum speed (i.e. the speed of drum 46) in revolutions per minute and the area of the surface of drum 46 in square meters gives the total flow rate of the pulp and water (including residual chemicals) in kilograms per minute. With an estimated consistency (e.g. by tonnage rate calculation of pulp entering the first stage and the percentage that valve 18 is open) that changes very little at a given set of conditions, this measurement is used to increase or decrease the opening of valve 23 to maintain the level of surface 42 in the previous tower at the desired point and to control rate of pulp flow from the bleaching tower. With all instruments assumed to have an accuracy of plus or minus 0.5 percent of scale, the inventive system herein has more than thirty times the sensitivity of controlling the rate of pulp flow out of the tower as the previously used level measurement alone. The pulp composition flow rate measurement is also used to calculate the amount of chemicals to be applied per minute into mixer 29 through pipe 68 (see FIG. 1) to achieve the desired percentage applied as determined by other parameters in the plant. For such purpose consistencies are readily determined based on the total weight measurement and the pulp tonnage input into the first stage; as experience is gained such consistencies can be correlated to the rate of rotation of drum 46 and the measurement by gauge 27. The amount of bleaching chemicals used relative to the amount of pulp normally ranges from about 4.0% in the second stage down to as low as 0.1% in the last stage. The pulp composition flow rate measurement is also readily used to control the amounts of other agents that may be introduced into the system, e.g. acids, alkalis, chelating agents, talc for pitch removal, defoaming agents and steam for heating. The addition of chemicals and agents is preferably controlled by automatically controlling valves in response to signals representing pulp rates calculated by a microprocessor in response to signals representing the rate of rotation of drum 46 and the readings of gauge 27. Less preferably, such control can be carried out by manually adjusting such valve in response to such data. The calculated value of pulp composition flow rate out of the tower 14 also provides a means to calculate the required water flow through line 11 into the pulp in tower 14 to achieve the desired consistency of about three percent.

Figure 3:
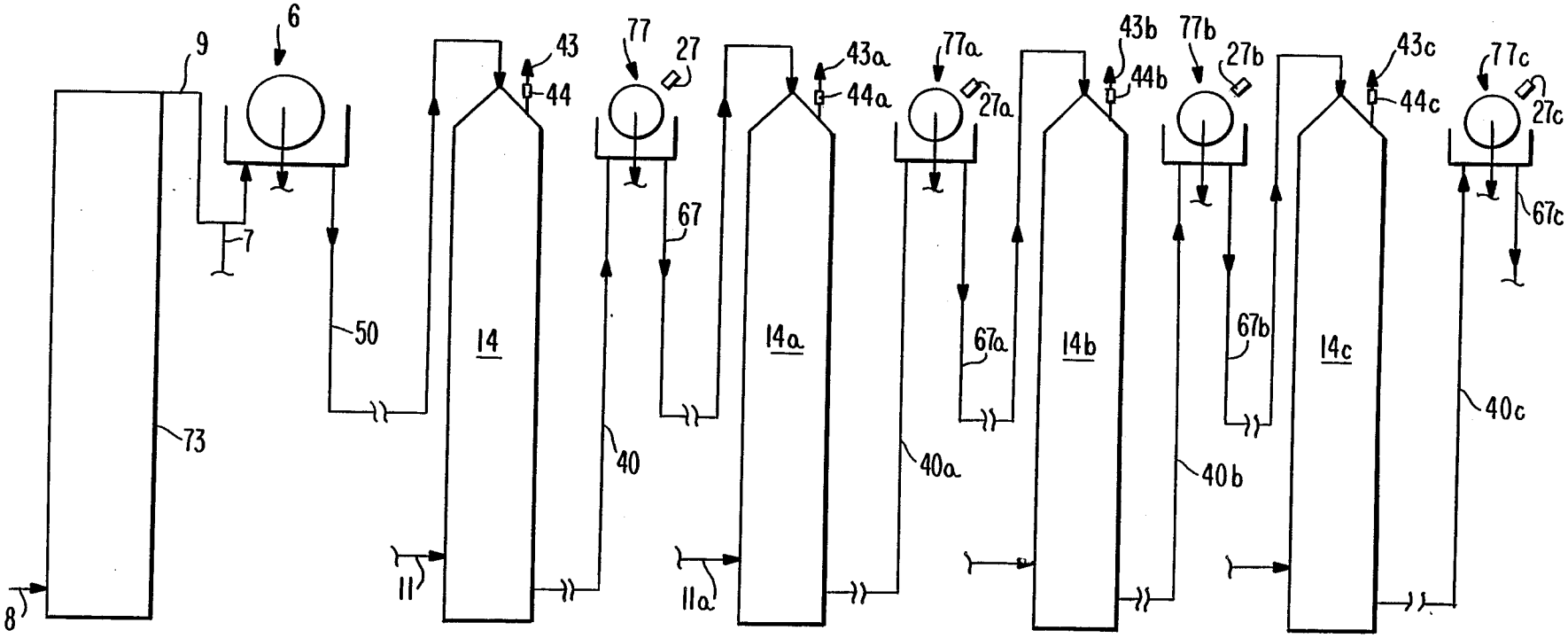
FIG. 3 is a schematic flow diagram of a five stage bleach plant comprising elements of FIG. 1, with portions omitted.

With reference to FIG. 3, a typical pulp bleaching operation consists of three to five sequential stages (FIG. 3 depicts 5 stages) that normally comprise bleaching towers used for retention time while the bleaching reaction takes place. Usually each tower is followed by a drum type washer. The operation is of the continuously flowing type whereby the wood pulp composition input 8 into a first stage upflow tower 73 as depicted in FIG. 3 comprises 3 to 5 percent pulp in a water suspension. The tower 73 is normally a simple upflow chlorination tower from which treated pulp composition exits at the top via a pipe 9. After introduction of wash water via a pipe 7, the composition flows by gravity into a drum type washer 6 which is normally of the same type as the drum type washer 77 described previously. The washed pulp composition exits washer 6 via a pipe 50 which routes the composition to a second bleaching stage of the type depicted in FIG. 1 as indicated by the same reference numerals denoting the same apparatus. The pulp is then routed through three more stages similar to the stage as detected in FIG. 1. In these succeeding stages, the same reference numerals are utilized to denote the same kind of apparatus as for stage 2 but are associated with letters a (to denote stage 3), b (to denote stage 4) and c (to denote stage 5). In the stages 2, 3, 4 and 5 backscatter nuclear radiation gauges 27, 27*a*, 27*b* and 27*c* are respectively utilized to measure pulp composition weight in kilograms per square meter on the drum washer surface, and this measurement is multiplied by drum speed and drum surface area to give total mass flow rate, and this data is used as a basis for controlling flow from the towers of stages 2, 3, 4 and 5 by means of controlling valves (not depicted) in respective outlet lines 40*a*, 40*b*, 40*c* and 40*d*. As pulp composition normally flows through the system continuously, any change in rate in one tower has an effect on all subsequent towers and associated washers and chemical applications.

The more uniform operation obtained that reduces the variability of pulp flow rates out of the bleaching towers, through pumps, and over the washer drums increases the maximum capacity of the system by allowing operation much closer to the maximum rate imposed by the limiting factor in the system. This limiting factor can be any of several items such as pumping capacity, washer drainage capacity, steam or chemical application restrictions, or even mixer efficiencies but regardless of the restriction the more uniform flow of pulp increases the maximum average output over a given time period.

The term "consistency is used herein to mean the percentage pulp in a pulp composition (i.e. a composition containing pulp and water).

When capacitance measuring instruments or microwave instruments (a microwave cavity perturbation apparatus) are used in place of a nuclear backscatter radiation gauge, the process of FIG. 1 is utilized except that reference numeral 27 denotes a capacitance measuring instrument or microwave cavity perturbation apparatus. Suitable capacitance measuring apparatus and microwave cavity perturbation apparatus are described in Seymour U.S. Pat. No. 4,207,141 and such description is incorporated herein by reference.

While the bleach plant system is described in detail, it should be noted that this type of system for tonnage measurement and control over a drum type washer or filter with a backscatter nuclear radiation gauge or capacitance measuring instrument or microwave cavity perturbation apparatus can be used in similar type situations. One such similar type operation where this type of system applies is to control the amount of feed stock for a lime kiln or cement kiln from a drum type filter.

It is, of course, understood that the foregoing description of the process of the present invention is intended to be illustrative and that modifications thereof as would be apparent to one skilled in the art are deemed to fall within the scope and spirit of the present invention as defined by the following claims.

I claim:

1. A method of controlling pulp and water flow rates out of at least one bleaching tower in a multistage pulp bleaching process wherein each stage comprises a bleaching tower and a rotatable washing drum having a surface area and a measured speed of rotation to obtain a more uniform rate and permitting improved control over bleaching chemicals addition, said method comprising the steps of (a) measuring the total weight of pulp composition per unit area on at least one washing drum;

(b) ascertaining a consistency for the pulp composition subjected to weight measurement in step (a);

(c) determining the total weight per unit time of pulp and of water coming out of a bleaching tower previous to said washing drum from the weight of pulp composition per unit area measured in step (a), the consistency for said pulp composition ascertained in step (b), the measured speed of rotation of said washing drum and said surface area of said washing drum;

(d) controlling the rate of the pulp and water flow out of said previous tower based on the determination of the total weight of pulp and of water per unit time as determined in step (c); and (e) controlling the amount of bleaching chemical flow to the pulp going to a following bleach stage to match the pulp flow rate as determined based on the measurement in step (a) and the percentage of bleaching chemicals to be applied to the pulp.

2. A process as claimed in claim 1, wherein the measurement of total weight of pulp composition per unit area on a washing drum is carried out by using a backscatter nuclear radiation gauge.

3. A process as claimed in claim 1, wherein the measurement of total weight of pulp composition per unit area on a washing drum is carried out by measuring the amount of water per unit area on said washing drum utilizing a capacitance measuring instrument and converting the measured amount of water to a measure of weight of pulp and water per unit area of drum surface utilizing pulp composition consistencies.

4. A process as recited in claim 1 wherein the measurement of total weight of pulp composition per unit area on a washing drum is carried out by measuring the amount of water per unit area in said washing drum utilizing a microwave cavity perturbation apparatus and converting the measured amount of water to a measure of weight of pulp and water utilizing pulp composition consistencies.

5. The method of claim 1 wherein pulp and water flow rates are controlled out of bleaching towers in successive fstages.

6. The method of claim 1, wherein pulp and water flow rates are controlled in each stage in the multistage bleaching process by the method comprising steps (a), (b), (c), (d) and (e) except the first stage.

* * * * *